US007101220B2

(12) United States Patent
Satou

(10) Patent No.: US 7,101,220 B2
(45) Date of Patent: Sep. 5, 2006

(54) FLEXIBLE BOARD CONNECTOR AND CONNECTION STRUCTURE OF FLEXIBLE BOARD TO CIRCUIT BOARD

(75) Inventor: Kunihiro Satou, Fukuyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/086,560

(22) Filed: Mar. 23, 2005

(65) Prior Publication Data

US 2005/0215109 A1 Sep. 29, 2005

(30) Foreign Application Priority Data

Mar. 29, 2004 (JP) ..... P2004-094409

(51) Int. Cl.
*H01R 12/24* (2006.01)

(52) U.S. Cl. ..... 439/492; 439/495

(58) Field of Classification Search ..... 439/492, 439/493, 495, 260
See application file for complete search history.

(56) References Cited

U.S. PATENT DOCUMENTS 3,989,336 A * 11/1976 Rizzio et al. ..... 439/260
5,688,143 A 11/1997 McHugh et al. ..... 439/495
6,755,682 B1 * 6/2004 Kunishi et al. ..... 439/495
2002/0045374 A1 4/2002 Kunishi et al. ..... 439/260
2005/0170685 A1 * 8/2005 Satou ..... 439/495

FOREIGN PATENT DOCUMENTS

JP 9-22760 A 1/1997
JP 10-27659 (A) 1/1998
WO WO 98/49756 A1 11/1998

OTHER PUBLICATIONS

European Search Report issued on Aug. 12, 2005.

* cited by examiner

*Primary Examiner*—Hae Moon Hyeon
(74) *Attorney, Agent, or Firm*—Harness, Dickey & Pierce, P.L.C.

(57) ABSTRACT

A casing 2 is arranged in a through hole 41 of a circuit board 40, and an outer contact portion 3*b* of a contact 3 projecting from the neighborhood of the upper end of the casing 2 is connected to a connection terminal 43 on the upper surface of the circuit board. By inserting an end portion of a flexible board 30 into an insertion opening 9 from an upper aperture 6 or a lower aperture 7 of the casing 2 and sliding a pressure piece 8 toward the outer contact portion 3*b* side, an inner contact portion 3*a* of the contact 3 and the end portion of the flexible board are fixed held between a thrust block 10 and the pressure piece 8.

7 Claims, 6 Drawing Sheets

FLEXIBLE BOARD CONNECTOR AND CONNECTION STRUCTURE OF FLEXIBLE BOARD TO CIRCUIT BOARD

This Nonprovisional application claims priority under 35 U.S.C. §119(a) on Patent Application No. 2004-094409 filed in Japan on Mar. 29, 2004, the entire contents of which are hereby incorporated by reference.

BACKGROUND OF THE INVENTION

The present invention relates to a flexible board connector for electrically connecting a flexible board to a circuit board and to a connection structure of a flexible board to a circuit board.

In recent years, electronic devices of portable telephones, video cameras and so on have been promoted reducing their size and weight while internally included many built-in electronic components. Many of the electronic components have leads and terminals electrically connected with solder to component mounting lands arranged on a circuit board. In portable telephones, of which the size reduction has been promoted, even comparatively large components such as LCD modules and keypads are arranged on a circuit board, and a plurality of such circuit boards are normally employed. In order to electrically connect the plurality of circuit boards with one another, many flexible boards are employed. Moreover, flexible boards are employed to electrically connect other parts of camera modules and so on to the circuit board. Such a flexible board is sometimes required to be connected from the lower surface side of the circuit board to the connector arranged together with the electronic components on the upper surface of the circuit board due to restrictions in design.

Conventionally, the following connection structures have been adopted in order to connect the flexible boards to the connectors of the circuit board from the lower surface side.

(1) As shown in FIG. 9, a circuit board 52, on the upper surface of which an electronic component 51 is arranged, is provided with a connector 53 on its upper surface and a through hole 52*a*. A flexible board 54 is guided from the lower surface side to the upper surface side of the circuit board 52 via the through hole 52*a*, and the connection portion of the flexible board 54 is connected to the connector 53.

(2) As shown in FIG. 10, a connector 63 is provided in the neighborhood of an edge portion of the circuit board 62 on the upper surface of which the electronic components 61 are arranged, and the connection portion of the flexible board 64 is connected to the connector 63 by bending the flexible board 64 so that the board covers the edge portion from the lower surface side of the circuit board 62.

(3) As shown in FIG. 11, a connector 73 is provided on the lower surface of a circuit board 72 on the upper surface of which the electronic components 71 are arranged, and a flexible board 74 on the lower surface side is connected to the connector 73 without being guided to the upper surface side.

Some of the conventional connectors 53, 63 and 73 hold and fix the connection portion of the flexible board between a base part fixed to the circuit board and a pivot part pivotally connected to the base part. Moreover, there is a connector, which is fixed to a circuit board, includes an engagement pawl and a contact terminal, engages the engagement pawl with an engagement hole of a flexible board and electrically connects the contact terminal to the connection terminal of the flexible board (refer to JP H09-22760).

However, the connection structure of the flexible board to the circuit board of the item (1) has a problem that, if the flexible board 54, which passed through the through hole 52*a*, receives vibrations or impact while being brought in contact with the edge of the through hole 52*a*, the wiring formed on the flexible board 54 is cut by the edge. As a method for solving the above problem, it can be considered to chamfer the edge of the through hole 52*a*, to arrange a cover to cover the edge, and to use a jig for shaping the flexible board 54 into a shape such that the board does not come in contact with the edge or the like. However, each of the methods has the problem of causing a cost increase. Moreover, the connection structure of the flexible board to the circuit board of the item (2) has a problem that restrictions on the circuit design increase since the connector 63 needs to be arranged at the edge portion of the circuit board 52 in addition to a problem similar to that of the item (1). There is a further problem that the total length of the flexible board 64 becomes long. The connection structure of the flexible board to the circuit board of the item (3) has a problem that the cost is increased further than when the electronic components and the connector are arranged on the upper surface since a wiring for the connector 73 also needs to be arranged on the lower surface despite that the electronic component 71 is arranged only on the upper surface of the circuit board 72.

What is particularly important to the electronic devices, of which the reductions in size and weight have been promoted, is a reduction in thickness. Therefore, in accordance with the reductions in size and thickness of electronic components and so on, the connectors for flexible boards are also demanded to be reduced in size and thickness.

However, the connectors 53, 63 and 73 of the items (1), (2) and (3), which are employed for the connection structure of the flexible board to the circuit board, have conventionally been arranged on the upper surface or the lower surface of the circuit boards 52, 62 and 72. Therefore, all of the connectors 53, 63 and 73 are to project from the surfaces of the circuit boards 52, 62 and 72. This therefore leads to a problem that the circuit boards 52, 62 and 72 and the flexible boards 54, 64 and 74 in the mutually connected state come to have a comparatively great thickness. It can be considered to reduce the thickness of the components of insulators, terminals and so on included in the connectors 53, 63 and 73 in order to reduce the thickness of the connectors 53, 63 and 73. However, this disadvantageously causes a reduction in structural strength, defective connection and so on.

SUMMARY OF THE INVENTION

An object of the present invention is to provide a flexible board connector which is capable of connecting a flexible board to a circuit board, irrespective of whether the flexible board is located on the upper surface side or the lower surface side of the circuit board, and which is reduced in thickness.

In order to achieve the above object, the present invention provides a flexible board connector comprising:

a casing;

a contact including an inner contact portion located inside the casing and an outer contact portion outwardly projecting from a neighborhood of an upper edge on a side surface of the casing;

a clamp being partially arranged in the casing and movable with respect to the casing, including a clamping surface and being able to narrow an insertion opening defined between the clamping surface and the inner contact portion of the contact by moving with respect to the casing; and a first aperture being contiguous to the insertion opening and provided on a lower surface of the casing.

According to the above configuration, the outer contact portion of the contact is connected to, for example, a connection terminal of the circuit on a circuit board. Moreover, part of a flexible board is inserted into the insertion opening defined between the clamping surface of the clamp and the inner contact portion of the contact, and the part of the flexible board is clamped by the clamp. With this arrangement, for example, a connection terminal formed in the part of the flexible board is electrically connected to the inner contact portion, and the part of the flexible board is fixed to the flexible board connector.

Moreover, the outer contact portion projects from the neighborhood of the upper edge on the side surface of the casing, and therefore, the outer contact portion is connected to the connection terminal or the like located on the upper surface of the circuit board in a state in which the casing is disposed, for example, in a through hole formed at the circuit board. That is, the flexible board connector can be electrically connected to the circuit board in a state in which at least part in the thickness direction overlaps the circuit board. Therefore, the flexible board connector is able to more effectively reduce the amount of projection from the circuit board than in the conventional connector arranged on the upper surface of the circuit board. As a result, the flexible board connector can reliably be connected to the circuit board while suppressing the amount of increase in the thickness of the circuit board and the flexible board. Moreover, by employing the flexible board connector, a size of an electronic device can effectively be reduced.

Moreover, the flexible board connector is employed for different flexible board and circuit board by forming the outer contact portion into a shape corresponding to the connection terminal of the circuit board to be connected and forming the inner contact portion into a shape corresponding to the connection terminal of the flexible board to be connected. That is, the flexible board connector, which can be applied to the different flexible board and circuit board by only changing the shape of the contact, has high versatility, consequently allowing the manufacturing cost to be reduced.

Moreover, the first aperture, which is contiguous to the insertion opening, is provided on the lower surface of the casing. Therefore, by arranging the casing in the through hole of the circuit board or taking a similar measure, the first aperture can be made to face the lower side of the circuit board. With this arrangement, the flexible board located on the lower side of the circuit board can be connected to the circuit board without via a through hole provided at the circuit board nor bending around an edge portion of the circuit board dissimilarly to the conventional case. Therefore, it is possible to prevent the flexible board from being cut dissimilarly to the conventional case, to arrange the connector in the desired position without being limited to the edge portion of the circuit board and to obviate the need for increasing the dimension of the flexible board for the bending around the edge portion of the circuit board. As a result, it is possible to prevent the reduction in the durability of the flexible board, to improve the degrees of freedom of the circuit design of the circuit board and to prevent the cost increase of the flexible board.

In one embodiment, the flexible board connector further comprises:

a second aperture being contiguous to the insertion opening and provided on an upper surface of the casing.

According to the embodiment, a flexible board located on the upper side of the casing can be connected to, for example, a circuit board via the second aperture. Therefore, the flexible board can be connected to the circuit board no matter whether the flexible board is located on the lower side or the upper side of the casing, and therefore, high versatility is obtained. Moreover, it is acceptable to connect the flexible board located on the lower side of the casing to the circuit board via the first aperture and connect the flexible board located on the upper side of the casing to the circuit board via the second aperture. That is, the flexible board connector of the present embodiment can connect the two flexible boards located on the mutually different sides with respect to the casing to the circuit board with one connector.

Further, a connection structure of a flexible board to a circuit board of one embodiment comprises:

the above flexible board connector, a circuit board including a board, a circuit formed on the board, a connection terminal formed on the board and connected to the circuit, and a through hole formed at the board adjacently to the connection terminal; and a first flexible board including a base having flexibility, a wiring formed on the base, and a connection terminal formed on the base and connected to the wiring, wherein the casing of the flexible board connector is partially disposed in the through hole of the circuit board, the connection terminal of the circuit board is connected to the outer contact portion of the contact of the flexible board connector, and the first flexible board has a portion inserted into the insertion opening of the flexible board connector via the first aperture of the flexible board connector, the portion is clamped by the clamp, and the connection terminal is connected to the inner contact portion of the contact of the flexible board connector.

According to the construction, the outer contact portion of the flexible board connector is connected to the connection terminal of the circuit board in a state in which at least part of the casing of the flexible board connector is disposed in the through hole of the circuit board, and the inner contact portion of the flexible board connector is connected to the connection terminal of the flexible board. With this arrangement, the circuit board and the flexible board are connected together in a state in which the portion of the flexible board connector projecting from the circuit board is much smaller than in the conventional case. Therefore, the connection structure of the flexible board to the circuit board has a thickness effectively reduced than in the conventional case. As a result, when the connection-structure of the flexible board to the circuit board is employed for an electronic device, the electronic device can be effectively reduced in size and thickness.

Moreover, part of the flexible board is inserted into the insertion opening via the first aperture provided on the lower surface of the casing of the flexible board connector. Therefore, the flexible board located on the lower side of the circuit board is connected to the circuit board without via a through hole of the circuit board nor bending around the edge portion of the circuit board dissimilarly to the conventional case. Therefore, it is possible to prevent the flexible board from being cut dissimilarly to the conventional case, to arrange the flexible board connector in the desired position without being limited to the edge portion of the circuit board and to obviate the need for increasing the dimension of the flexible board for bending around the edge portion of the circuit board. As a result, it is possible to prevent the reduction in the durability of the flexible board, to improve the degrees of freedom of the circuit design of the circuit board and to prevent the cost increase of the flexible board.

In one embodiment, the connection structure of the flexible board to the circuit board further comprises:

a second flexible board including a base having flexibility, a wiring formed on the base, and a connection terminal formed on the base and connected to the wiring, wherein the flexible board connector has a second aperture that is contiguous to the insertion opening and provided on an upper surface of the casing, and the second flexible board is constituted so that a portion thereof is inserted into the insertion opening of the flexible board connector via the second aperture of the flexible board connector, the portion is clamped by the clamp, and the connection terminal is connected to the inner contact portion of the contact of the flexible board connector.

According to the embodiment, the second flexible board is partially inserted into the insertion opening via the second aperture of the flexible board connector and connected to the circuit board. Therefore, the first flexible board and the second flexible board, which are located on the mutually different sides with respect to the circuit board, are connected to the circuit board. Moreover, at least part of the casing of the flexible board connector is disposed in the through hole of the circuit board, and the amount of projection from the circuit board is comparatively small. Therefore, a connection structure of the two flexible boards can be obtained while suppressing the amount of increase in thickness.

In one embodiment of the connection structure of a flexible board to a circuit board, the portion of the first flexible board and the portion of the second flexible board have shapes such that the portions do not overlap each other in the insertion opening of the flexible board connector and have roughly mutually identical shapes.

According to the embodiment, the first and second flexible boards have the portions, which are inserted into the insertion opening of the flexible board connector and have the shapes such that the boards do not overlap each other in the insertion opening and have roughly identical shapes. Therefore, the flexible boards, of which the portions have roughly identical shapes, are connected to the circuit board while being arranged on both the upper side and the lower side of the flexible board connector, and therefore, high versatility is obtained.

As described above, the flexible board connector of the present invention comprises a casing, a contact including an inner contact portion located inside the casing and an outer contact portion outwardly projecting from a neighborhood of an upper edge on a side surface of the casing, a clamp being partially arranged in the casing and movable with respect to the casing, including a clamping surface and being able to narrow an insertion opening defined between the clamping surface and the inner contact portion of the contact by moving with respect to the casing, and a first aperture being contiguous to the insertion opening and provided on a lower surface of the casing. Therefore, it is possible to dispose the casing in a through hole of the circuit board and insert a part of the flexible board from the lower side of the casing into the insertion opening via the first opening for the electrical and mechanical fixation of the flexible board. Therefore, the flexible board located on the lower side of the circuit board can be connected to the circuit board without causing the problems of the cut of the wiring, the increase in length and so on nor largely increasing the total thickness.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
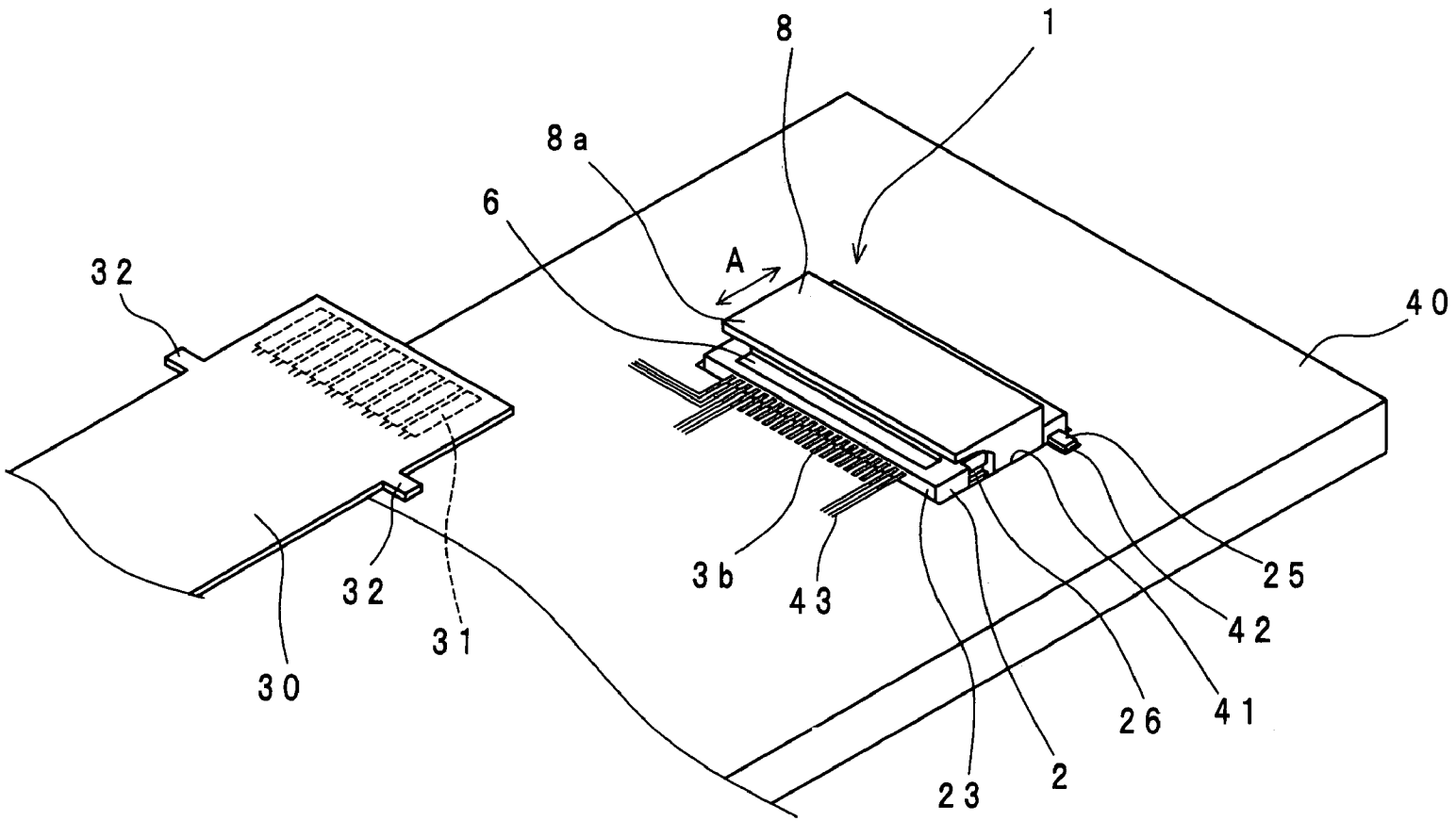
FIG. 1 is a perspective view showing a flexible board connector of an embodiment of the present invention.

The present invention will be described in detail below on the basis of the embodiments shown in the drawings.

FIG. 1 is a perspective view showing a flexible board connector 1 of an embodiment of the present invention. The flexible board connector 1 fixes a flexible board 30 to a circuit board 40 and electrically connects the wiring of the flexible board 30 to the circuit of the circuit board 40.

The flexible board connector 1 has a roughly rectangular parallelepiped casing 2, and the casing 2 is arranged in a roughly rectangular through hole 41 formed at the circuit board 40. The casing 2 has an upper end portion projecting from the upper surface of the circuit board 40.

The flexible board connector 1 has a plurality of conductive contacts 3 for electrically connecting the circuit of the circuit board 40 to the wiring of the flexible board 30.

The contacts 3 each have an inner contact portion 3*a* located inside the casing 2 and an outer contact portion 3*b* located outside the casing 2. The outer contact portions 3*b* of the contacts 3 project from a side surface 23 that is the side surface of the portion of the casing 2 projecting from the upper surface of the circuit board 40 and extends in the lengthwise direction of the casing. The plurality of contacts 3 are arranged in the lengthwise direction of the casing 2 and extend mutually parallel in the short-side direction of the casing 2.

The outer contacts 3*b* of the contacts 3 are electrically connected with solder to a connection terminal 43 formed in the neighborhood of the through hole 41 of the circuit board 40. The connection terminal 43 is connected to the circuit (not shown) of the circuit board 40.

The casing 2 has an upper aperture 6 as a second aperture that has on its upper surface a rectangular shape extended in the lengthwise direction of the upper surface of the casing 2. The upper aperture 6 is adjacent to the side surface 23 from which the outer contact portions 3*b* of the contact 3 project. The upper aperture 6 is contiguous to an insertion opening formed in the casing 2, and the end portion of the flexible board 30 is formed so as to be inserted into the opening.

On the back surface at the end portion of the flexible board 30, i.e., the surface facing toward the flexible board connector 1 in FIG. 1 is formed a connection terminal 31 connected to the wiring (not shown) of the flexible board. Moreover, two projections 32 and 32, which project in the widthwise direction of the flexible board, are provided adjacently to the connection terminal 31 at both the edges extended in the lengthwise direction of the flexible board.

Moreover, two projections 25 are provided on both side surfaces in the short-side direction of the casing 2 adjacently to the side surface facing against the side surface 23 of the casing 2. The projections 25 project in the lengthwise direction of the casing 2 and are engaged with shallow engagement holes 42 contiguous to the through hole 41 of the circuit board 40. The projections 25 are bonded to the inner side surfaces of the engagement holes 42 with solder or the like, preventing the connector 1 from being displaced and falling off.

The greater part of the upper surface of the casing 2 is covered with the upper portion of the pressure piece 8 that serves as a clamp. The upper portion of the pressure piece 8 has a rectangular shape in plan, and the dimension of the long side is formed approximately equal to the dimension in the lengthwise direction of the casing 2. A support portion extended along the side surface of the casing 2 is contiguous to the short edge of the upper portion of the pressure piece 8, and an engagement pawl is formed on the inner side surface of the support portion. The engagement pawl is engaged with a guide groove 26 formed on the side surface of the casing 2, and the pressure piece 8 is made movable in the short-side direction along the guide groove 26 as indicated by arrow A. A cover portion 8*a* is formed at the edge part of the long side of the upper portion of the pressure piece 8, and the cover portion 8*a* is located above the upper aperture 6 of the casing 2 in accordance with the movement of the pressure piece 8 toward the side surface 23 side of the casing.

Figure 2:
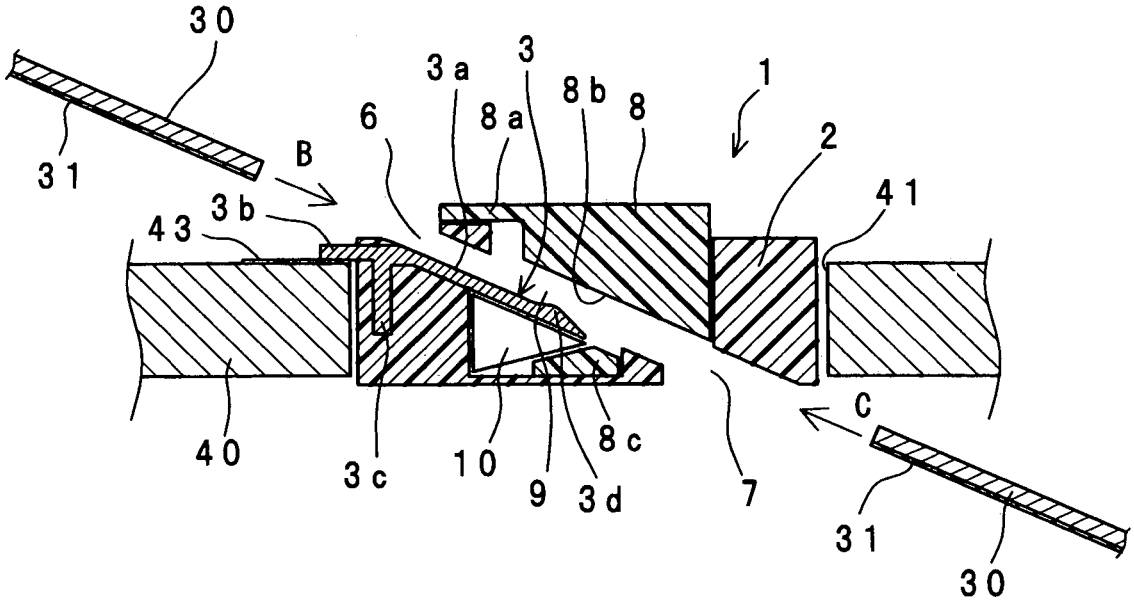
FIG. 2 is a sectional view in a short-side direction of a flexible board connector placed in a circuit board.

FIG. 2 is a sectional view in a short-side direction of a flexible board connector 1 placed in a circuit board 40.

As shown in FIG. 2, the casing 2 has a lower aperture 7 that serves as a first aperture on its lower surface. The lower aperture 7 has a dimension approximately equal to the dimension of the upper aperture 6, and the apertures are formed on mutually opposite sides in plan of the casing 2.

The inner contact portion 3*a* of the contact 3 is arranged in the casing 2. The inner contact portion 3*a* is contiguous to the outer contact portion 3*b* and is extended along the inner side surface of the casing 2 and an upper surface of a wedge-shaped thrust block 10 arranged in the casing 2. A contact terminal 3*d*, which is increased in thickness, is formed at the end of the inner contact portion 3*a* of the first contact 3. A fixing portion 3*c* extended toward a bottom portion of the casing 2 is integrally connected to a portion located between the inner contact portion 3*a* and the outer contact portion 3*b* of the contact 3, and the fixing portion 3*c* is engaged with a fixing hole formed inside the casing 2.

In the casing 2, an insertion opening 9 is defined by the clamping surface 8*b* that is the lower surface of the pressure piece 8, the inner contact portion 3*a* of the contact 3, the inner surface of the casing 2, and the upper surface of the thrust block 10. The insertion opening 9 communicates with the upper aperture 6 of the casing 2 and the lower aperture 7 of the casing. The insertion opening 9 is inclined with respect to the bottom surface of the casing 2. The flexible board 30 can be inserted from the upper aperture 6 of the casing as indicated by arrow B, and the flexible board 30 can be inserted from the lower aperture 7 of the casing as indicated by arrow C into the insertion opening 9.

Below the insertion opening 9 is arranged a slide piece 8*c*, which is formed integrated with the pressure piece 8 and moved together with the pressure piece 8. On the upper surface of the slide piece 8*c* is formed an inclined surface, which is downwardly inclined toward the outer contact portion 3*b* side in cross section in the short-side direction of the connector. The thrust block 10 is arranged on the slide piece 8*c*. A surface of the thrust block 10, put in contact with the slide piece 8*c*, is an inclined surface that is downwardly inclined toward the outer contact portion 3*b* side. On the other hand, the surface of the thrust block 10, located on the insertion opening 9 side, is an inclined surface that is upwardly inclined toward the outer contact portion 3*b* side. The surface of the thrust block 10 on the insertion opening 9 side and the lower surface of the inner contact portion 3*a* are located adjacently roughly parallel to each other.

Figure 3:
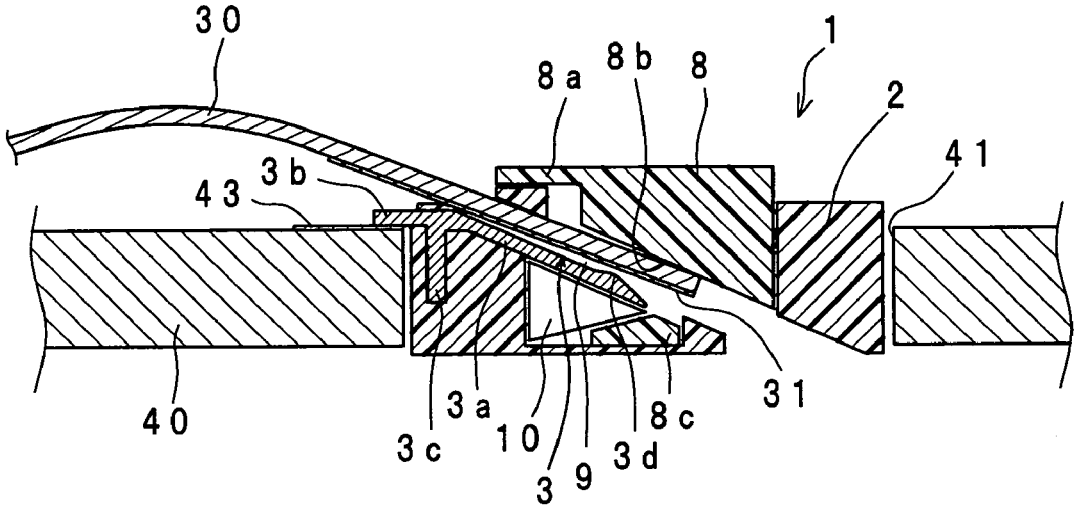
FIG. 3 is a view showing a process of connecting the flexible board located on an upper surface side of the circuit board to the circuit board with the flexible board connector.
Figure 4:
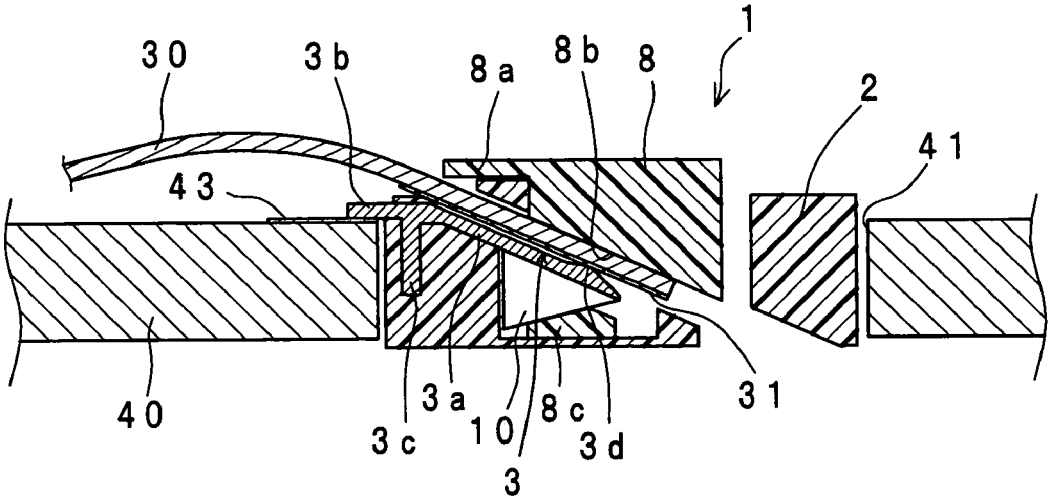
FIG. 4 is a view showing a process of connecting the flexible board located on an upper surface side of the circuit board to the circuit board, continuously from FIG. 3.

FIGS. 3 and 4 are views showing a process of connecting the flexible board 30 located on an upper surface side of the circuit board 40 to the circuit board 40 with the flexible board connector 1.

First of all, when the cover portion 8*a* is positioned above the upper aperture 6 of the casing, the pressure piece 8 is moved in a direction away from the outer contact portion 3*b*, and then the upper aperture 6 is exposed to the outside as shown in FIG. 3. When the pressure piece 8 is moved in the direction away from the outer contact portion 3*b*, the slide piece 8*c* is moved together with the pressure piece 8 away from the outer contact portion 3*b*, as a consequence of which the thrust block 10, whose lower surface is put in contact with the inclined upper surface of the slide piece 8*c*, moves to the bottom surface side of the casing 2.

The end portion, in which the connection terminal 31 of the flexible board is formed, is inserted from the exposed upper aperture 6 into the casing 2. The projections 32 and 32, which are formed in the neighborhood of the end portion of the flexible board 30, are engaged with the edge portions of the upper aperture 6 of the casing, as a consequence of which the end portion of the flexible board 30 is inserted into the casing 2 by a prescribed length. The end portion of the flexible board 30 inserted into the casing 2 is disposed in the insertion opening 9 between the clamping surface 8*b* of the pressure piece 8 and the inner contact portion 3.

Subsequently, as shown in FIG. 4, the pressure piece 8 is moved toward the outer contact portion 3*b* side. By this operation, the clamping surface 8*b* of the pressure piece 8 depresses the flexible board 30. Moreover, the slide piece 8*c* is moved together with the pressure piece 8 toward the outer contact portion 3*b* side, as a consequence of which the thrust block 10 is moved upward. Consequently, the upper surface of the thrust block 10 pushes up the inner contact portion 3*a* of the contact 3. Thus, the insertion opening 9 is narrowed, and the portion of the flexible board 30 and the inner contact portion 3*a* of the contact are held between the clamping surface 8*b* of the pressure piece 8 and the upper surface of the thrust block 10. As a result, the connection terminal 31 of the flexible board 30 and the contact terminal 3*d* of the contact are reliably brought in contact with each other, achieving electrical and mechanical connection.

Thus, the connection structure of the flexible board to the circuit board of the present invention is obtained with regard to the flexible board 30 located on the upper surface side of the circuit board 40.

Figure 5:
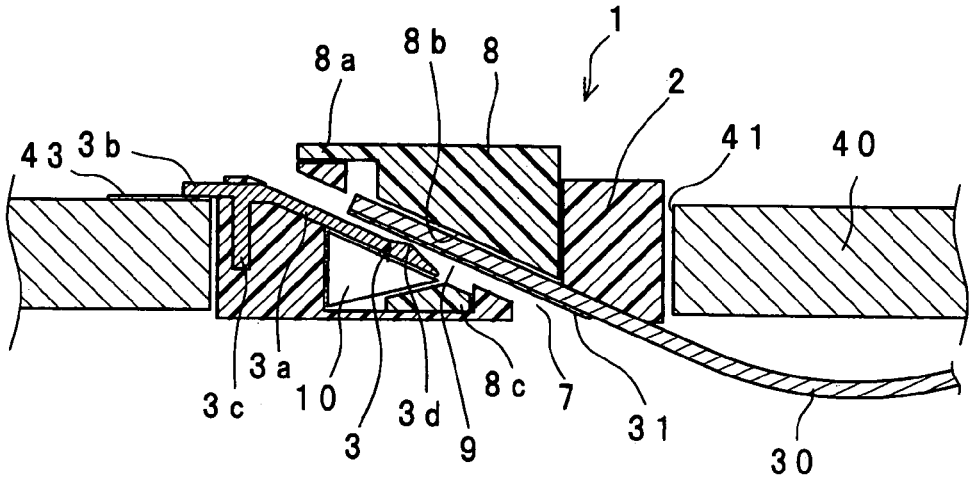
FIG. 5 is a view showing a process of connecting the flexible board located on an lower surface side of the circuit board to the circuit board with the flexible board connector.
Figure 6:
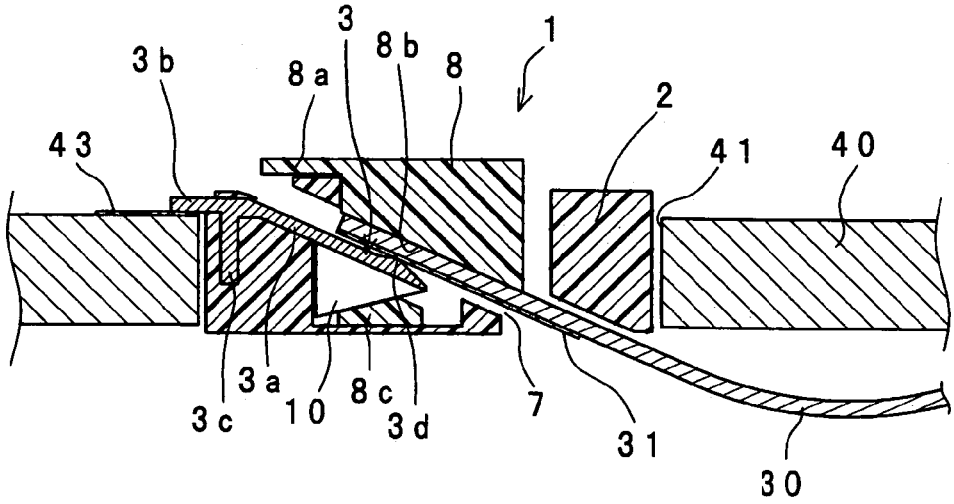
FIG. 6 is a view showing a process of connecting the flexible board located on an lower surface side of the circuit board to the circuit board, continuously from FIG. 5.

FIGS. 5 and 6 are views showing a process of connecting the flexible board 30 located on an lower surface side of the circuit board 40 to the circuit board 40 with the flexible board connector 1.

First of all, when the cover portion 8*a* is positioned above the upper aperture 6 of the casing, i.e., when the insertion opening 9 is narrowed, the pressure piece 8 is moved in the direction away from the outer contact portion 3*b*, so that the width of the insertion opening 9 becomes approximately equal to the width of the lower aperture 7 of the casing as shown in FIG. 5.

The end portion of the flexible board located on the lower surface side of the circuit board 40 is inserted into the casing 2 from the lower aperture 7. The connection terminal 31 is formed at the end portion of the flexible board. The projections 32 and 32 formed in the neighborhood of the end portion are engaged with the edge portions of the lower aperture 7 of the casing, as a consequence of which the end portion of the flexible board 30 is inserted into the casing 2 by a prescribed length. The end portion of the flexible board 30 inserted into the casing 2 is disposed in the insertion opening 9 between the clamping surface 8*b* of the pressure piece 8 and the inner contact portion 3.

Subsequently, as shown in FIG. 6, the pressure piece 8 is moved to the outer contact portion 3*b* side. By this operation, the clamping surface 8*b* of the pressure piece 8 depresses the flexible board 30. Moreover, the slide piece 8*c* is moved together with the pressure piece 8 toward the outer contact portion 3*b* side, as a consequence of which the thrust block 10 is moved upward. Consequently, the upper surface of the thrust block 10 pushes up the inner contact portion 3*a* of the contact 3. Thus, the insertion opening 9 is narrowed, and the portion of the flexible board 30 and the inner contact portion 3*a* of the contact are held between the clamping surface 8*b* of the pressure piece 8 and the upper surface of the thrust block 10. As a result, the connection terminal 31 of the flexible board 30 and the contact terminal 3*d* of the contact are reliably brought in contact with each other, achieving electrical and mechanical connection.

Thus, the connection structure of the flexible board to the circuit board of the present invention is obtained with regard to the flexible board 30 located on the lower surface side of the circuit board 40.

According to the connection structure of the flexible board to the circuit board, the flexible board connector 1 can connect the flexible board 40 located on either the upper side or the lower side of the circuit board 40 to the circuit board 40 via the upper aperture 6 or the lower aperture 7. Therefore, the flexible board 40 located on the lower side of the circuit board 40 can be connected to the circuit board 40 without via the through hole of the circuit board nor bending around the edge portion of the circuit board dissimilarly to the conventional case. As a result, the problem of the cutting of the flexible board, the problem of increasing the size and length of the flexible board and the problem of limiting the arrangement position of the flexible board connector can be prevented, dissimilarly to the conventional case. Moreover, there is no need to lead the connection terminal of the circuit of the circuit board to the lower surface side in order to arrange the flexible board connector on the lower surface of the circuit board. That is, the circuit board is not required to be provided with wiring on both sides as a wiring for the circuit on the upper side and a wiring for the connection terminal on the lower side. Therefore, it is possible to prevent the reduction in the durability of the flexible board, to improve the degrees of freedom of the circuit design of the circuit board and to prevent the cost increase of the flexible board.

Moreover, the flexible board connector 1 is able to connect the flexible board 30 to the circuit board 40 no matter whether the flexible board 30 is located on the upper surface side or the lower surface side of the circuit board 40, and therefore, high versatility is obtained. For example, if the flexible board connector 1 is adopted to an electronic device and the flexible board 40 is connected to, for example, an LCD module, a camera module or the like, the LCD module or the camera module can be arranged with high degrees of freedom without suffering limitations on the arrangement position thereof with respect to the circuit board 40.

Figure 7:
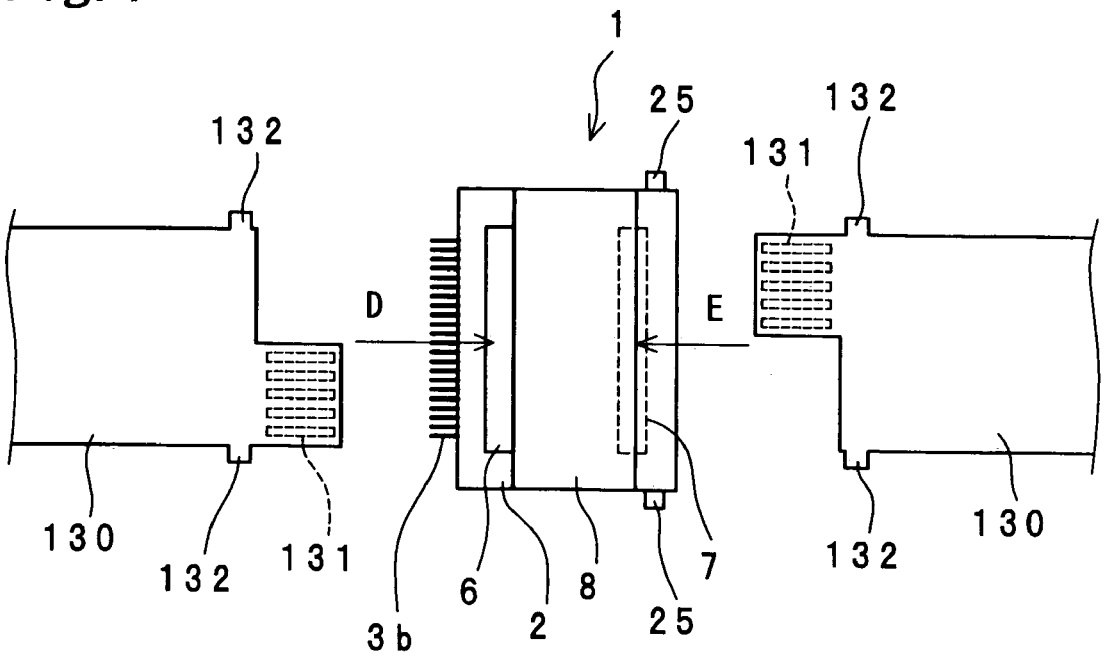
FIG. 7 is a plan view showing constituent parts constituting a connection structure of a flexible board to a circuit board of another embodiment of the present invention.
Figure 8:
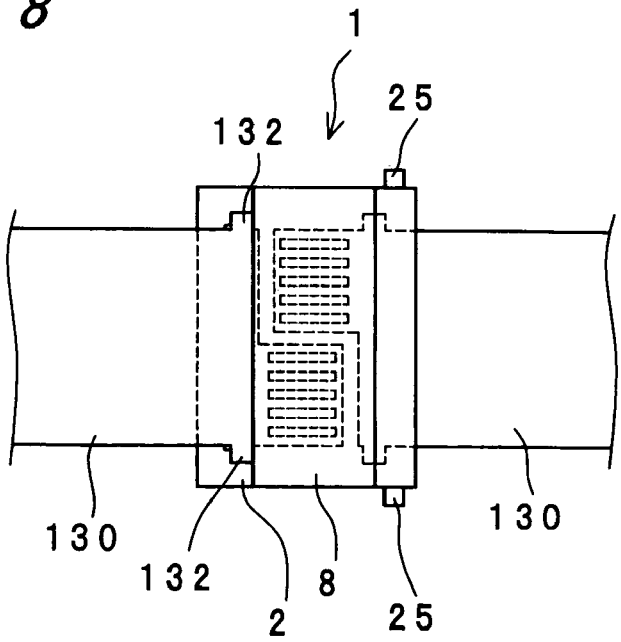
FIG. 8 is a plan view showing the connection structure of the flexible board to the circuit board constructed of the constituent parts of FIG. 7.
Figure 9:
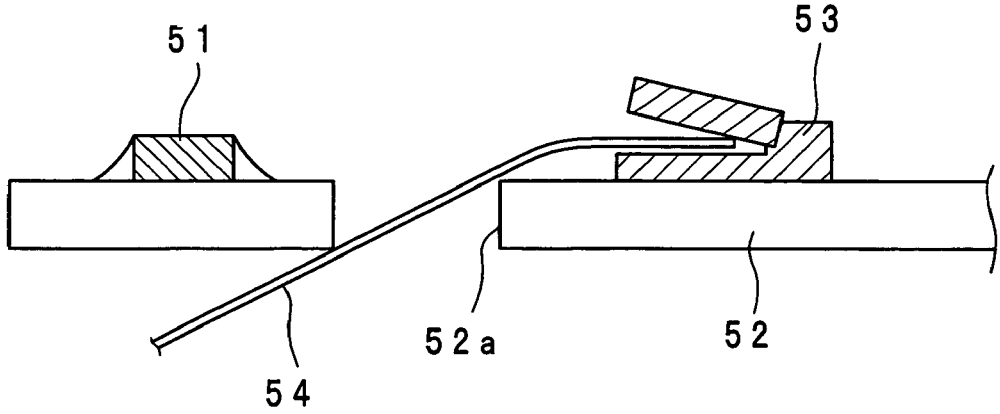
Fig. 9 BACKGROUND ART
FIG. 9 is a view showing a conventional connection structure of a flexible board to a circuit board.
Figure 10:
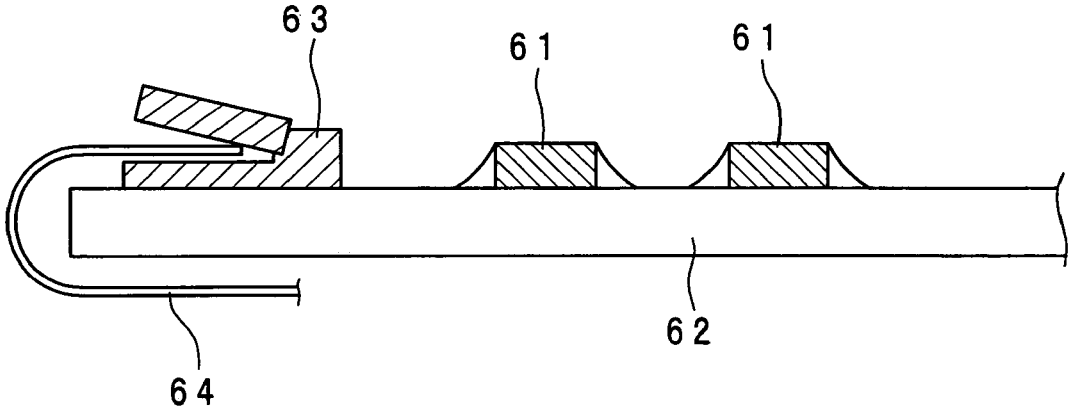
Fig. 10 BACKGROUND ART
FIG. 10 is a view showing a conventional connection structure of a flexible board to a circuit board.
Figure 11:
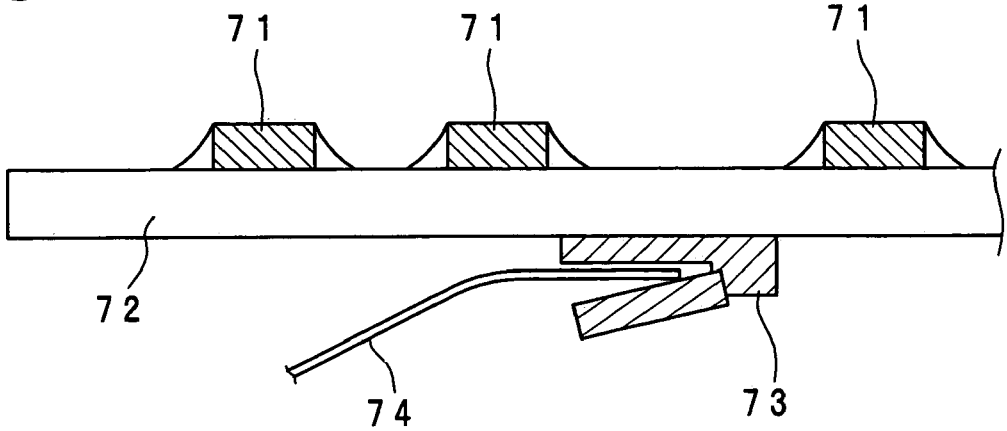
Fig. 11 BACKGROUND ART
FIG. 11 is a view showing a conventional connection structure of a flexible board to a circuit board.

FIGS. 7 and 8 are plan views showing constituent parts constituting a connection structure of a flexible board to a circuit board of another embodiment of the present invention. The connection structure of the flexible board to the circuit board of the present embodiment is constructed of the flexible board connector of FIG. 1 and differs from the connection structures of FIGS. 3 to 6 in that the shape of the end portion of the flexible board is varied. In the present embodiment, the same constituent parts as those of the embodiment already described are denoted by the same reference numerals, and no detailed description is provided therefor. Although the circuit board 40 is located in the thickness direction between two flexible boards 130 and 130 in FIGS. 7 and 8, the circuit board 40 is not shown in the figures.

As shown in FIG. 7, the flexible board 130 of the present embodiment has an end shape such that it is partially cut away from the center in the widthwise direction. Both of the two flexible boards 130 and 130 have an identical shape. On the other portion extended from the center of the flexible board 130, a connection terminal 131 is formed on the lower surface side in FIGS. 7 and 8, i.e., on the lower side on which the lower aperture 7 of the flexible board connector 1 is arranged. Moreover, two projections 132 and 132, which project in the widthwise direction of the flexible board adjacently to the connection terminal 131, are provided at the edges on both sides extended in the lengthwise direction of the flexible board 130.

As shown in FIG. 7, the end portion of the flexible board 130 located on the upper surface side of the circuit board is inserted into the casing 2 from the upper aperture 6 of the casing of the flexible board connector as indicated by arrow D. The end portion of the flexible board 130 is inserted into the casing 2 by a prescribed length by engaging the projections 132 and 132 with the edge portions of the upper aperture 6. Moreover, the end portion of the flexible board 130 located on the lower surface side of the circuit board is inserted into the casing 2 from the lower aperture 7 of the casing of the flexible board connector as indicated by arrow E. The end portion of the flexible board 130 is inserted into the casing 2 by a prescribed length by engaging the projections 132 and 132 with the edge portions of the lower aperture 7.

The end portions of the two flexible boards 130 and 130, which have an identical shape and are disposed in the insertion opening 9 mutually invertedly with respect to the flexible board connector 1, do therefore not overlap each other in the insertion opening 9. Subsequently, by moving the pressure piece 8 of the flexible board connector toward the outer contact portion 3*b*, the end portions of the flexible boards 130 and 130 are held between the clamping surface 8*b* of the pressure piece 8 and the upper surface of the thrust block 10. Consequently, the end portions of the two flexible boards 130 and 130 are fixed to the circuit board via the flexible board connector 1, and the connection terminals 131 and 131 of the two flexible boards 130 and 130 are electrically connected to the connection terminals 43 of the circuit board via the flexible board connector 1. Thus, the connection structure of the circuit board with the two flexible boards 130 and 130 located on the upper surface side and the lower surface side of the circuit board is obtained.

As described above, according to the connection structure of the flexible board to the circuit board of the present embodiment, the end portions of the flexible boards 130 are made to have the shapes such that the end portions do not overlap each other in the insertion opening 9 of the flexible board connector, the two flexible boards 130 and 130 located on both the upper and lower surface sides of the circuit board can be connected to the circuit board.

Although the end portions of the two flexible boards 130 and 130 located on both the upper and lower surface sides have the roughly identical shapes in the present embodiment, the end portions may have mutually different shapes. For example, it is acceptable to increase the width of the portion where the connection terminal 131 at the end portion of one flexible board 130 is formed and reduce the width of the portion where the connection terminal 131 at the end portion of the other flexible board 130 is formed. It is essential that the end portions be only required to have shapes such that the end portions do not overlap each other in the insertion opening 9 of the flexible board connector 1. The numbers of connection terminals 131 to be formed at the end portions of the flexible boards may, of course, be varied on the two flexible boards 130 and 130. Moreover, the total number of the connection terminals 131 and 131 of the two flexible boards 130 and 130 may be smaller than the total number of the contacts 3 of the flexible board connector.

It is acceptable to bend the flexible board 130 inserted in the upper aperture 6 by means of the cover portion 8*a* of the pressure piece elongated toward the projection side in the embodiment. That is, the elongated cover portion 8*a* is located above the upper aperture 6 of the casing 2 and the portion of the flexible board 130, which is located outside the insertion opening 9 of the casing 2, is leaned toward the upper surface of the casing 2 as the pressure piece 8 is moved toward the outer contact portion 3*b* side. With this arrangement, the portion of the flexible boards 130, which is located outside the insertion opening 9, can be directed roughly parallel to the upper surface of the circuit board 40 and prevented from projecting in a direction away from the circuit board 40.

Moreover, although the flexible board connector 1 of the embodiment has had the casing 2 partially disposed in the through hole 41 of the circuit board, it is acceptable to dispose the entire casing in the through hole 41. With this arrangement, the flexible board connector can be made to scarcely project from the circuit board 40. In this case, it is proper to lead the contact to the outside from the upper surface of the casing.

Moreover, the thrust block 10 in the casing 2 may be removed. That is, the insertion opening 9 may be narrowed only by the pressure piece 8.

Moreover, the flexible board connector 1 is allowed to have only the lower aperture 7 without providing the upper aperture 6. With this arrangement, the circuit board, which have a wiring for the circuit and a wiring for the connection terminal formed only on the upper surface thereof, can be connected with the flexible board on the lower surface side without providing a double-sided wiring.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A flexible board connector comprising:

a casing;

a contact including an inner contact portion located inside the casing and an outer contact portion outwardly projecting from a neighborhood of an upper edge on a side surface of the casing;

a clamp being partially arranged in the casing and movable with respect to the casing, including a clamping surface and being able to narrow an insertion opening defined between the clamping surface and the inner contact portion of the contact by sliding with respect to the casing; and a first aperture being contiguous to the insertion opening and provided on a lower surface of the casing.

2. The flexible board connector as claimed in claim 1, further comprising:

a second aperture being contiguous to the insertion opening and provided on an upper surface of the casing.

3. The flexible board connector as claimed in claim 2, wherein the second aperture is positioned on the other end side of the insertion opening.

4. The flexible board connector as claimed in claim 1, wherein the insertion opening is elongate and extends straight in a direction, and the inner contact portion of the contact defines only one side of the insertion opening, and the first aperture is positioned on one end side of the insertion opening.

5. A connection structure of a flexible board to a circuit board, comprising:

a flexible board connector including, a casing, a contact including an inner contact portion located inside the casing and an outer contact portion outwardly projecting from a neighborhood of an upper edge on a side surface of the casing, a clamp being partially arranged in the casing and movable with respect to the casing, including a clamping surface and being able to narrow an insertion opening defined between the clamping surface and the inner contact portion of the contact by moving with respect to the casing, and a first aperture being contiguous to the insertion opening and provided on a lower surface of the casing;

a circuit board including a board, a circuit formed on the board, a connection terminal formed on the board and connected to the circuit, and a through hole formed at the board adjacently to the connection terminal; and a first flexible board including a base having flexibility, a wiring formed on the base, and a connection terminal formed on the base and connected to the wiring, wherein the casing of the flexible board connector is partially disposed in the through hole of the circuit board, the connection terminal of the circuit board is connected to the outer contact portion of the contact of the flexible board connector, and the first flexible board has a portion inserted into the insertion opening of the flexible board connector via the first aperture of the flexible board connector, the portion is clamped by the clamp, and the connection terminal is connected to the inner contact portion of the contact of the flexible board connector.

6. The connection structure of the flexible board to the circuit board as claimed in claim 5, further comprising:

a second flexible board including a base having flexibility, a wiring formed on the base, and a connection terminal formed on the base and connected to the wiring, wherein the flexible board connector has a second aperture that is contiguous to the insertion opening and provided on an upper surface of the casing, and the second flexible board is constituted so that a portion thereof is inserted into the insertion opening of the flexible board connector via the second aperture of the flexible board connector, the portion is clamped by the clamp, and the connection terminal is connected to the inner contact portion of the contact of the flexible board connector.

7. The connection structure of the flexible board to the circuit board as claimed in claim 6, wherein the portion of the first flexible board and the portion of the second flexible board have shapes such that the portions do not overlap each other in the insertion opening of the flexible board connector and have roughly mutually identical shapes.

* * * * *